US006866932B2

(12) United States Patent
Sato et al.

(10) Patent No.: US 6,866,932 B2
(45) Date of Patent: Mar. 15, 2005

(54) OLEFIN-BASED RESIN COMPOSITION, METHOD OF MAKING IT AND ELECTRICAL WIRE COVERED WITH IT

(75) Inventors: Masashi Sato, Yokkaichi (JP); Tatsuya Hase, Yokkaichi (JP); Hiroshi Fujimoto, Yokkaichi (JP)

(73) Assignees: Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 206 days.

(21) Appl. No.: 09/770,196

(22) Filed: Jan. 29, 2001

(65) Prior Publication Data

US 2002/0011347 A1 Jan. 31, 2002

(30) Foreign Application Priority Data

Jan. 20, 2000 (JP) ..... 2000-011790

(51) Int. Cl.[7] ..... D01G 3/00; H01B 5/00

(52) U.S. Cl. ..... 428/375; 428/372; 428/378; 428/379; 428/391; 428/394; 174/110 R; 174/120 SR

(58) Field of Search ..... 428/378, 391, 428/394, 407, 379, 372, 375; 523/300; 174/110 R, 121, 120 SR, 126.2

(56) References Cited

U.S. PATENT DOCUMENTS 4,673,620 A * 6/1987 Shulman et al. ..... 428/379
4,722,959 A * 2/1988 Inoue et al. ..... 524/412
4,853,154 A * 8/1989 Icenogle et al. ..... 252/602
4,859,366 A * 8/1989 Djiauw et al. ..... 252/602
4,869,848 A * 9/1989 Hasegawa et al. ..... 252/609
4,948,669 A * 8/1990 Rolland ..... 428/379
5,039,845 A * 8/1991 Clough et al. ..... 219/543
5,180,889 A * 1/1993 Rogers et al. ..... 174/113
5,561,185 A * 10/1996 Hashimoto et al. ..... 524/436
5,578,666 A * 11/1996 Weil et al. ..... 524/100

FOREIGN PATENT DOCUMENTS

| | | | |
|---|---|---|---|
| EP | 0 273 516 A2 | | 7/1988 |
| EP | 0 273 516 | * | 7/1988 |
| JP | A-6-290638 | | 10/1994 |
| JP | A-7-78518 | | 3/1995 |
| JP | A-7-176219 | | 7/1995 |

* cited by examiner

*Primary Examiner*—Dawn Garrett
*Assistant Examiner*—Camie S Thompson
(74) *Attorney, Agent, or Firm*—Oliff & Berridge, PLC

(57) ABSTRACT

An olefin-based resin composition contains (a) 39–94 parts by weight of a propylene homopolymer or propylene-ethylene copolymer of at least 50 wt. % propylene content, having a melt-flow rate of 0.1–5 g/10 min, (b) 1–20 parts by weight of a polypropylene modified with 0.1–10% by weight of an acid anhydride, (c) 5–60 parts by weight of a styrene-based polymeric elastomer modified with 0.1–10% by weight of an acid anhydride, the total of components (a), (b) and (c) being 100 parts by weight, and (d) 30–200 parts by weight of a metal hydroxide. This halogen-free resin composition has a good balance of properties such as wear resistance, flame resistance, tensile properties and flexibility, which are required for the covering material of an electrical wire for an automobile.

11 Claims, No Drawings

OLEFIN-BASED RESIN COMPOSITION, METHOD OF MAKING IT AND ELECTRICAL WIRE COVERED WITH IT

BACKGROUND OF THE INVENTION

1. Field of Invention

This invention relates to a halogen-free resin composition containing metal hydroxide, to a method of making the resin composition and to electrical wire having this resin composition as a covering on an electrical conductor core. Such an electrical wire is useful, for example, in a motor vehicle.

2. Description of Related Art

Polyvinyl chloride has been widely used as the covering material of electrical wire for an automobile, because it is superior in properties such as mechanical strength, extrusion processability, flexibility and coloring property. However, with recent concern for the global environment, halogen-free resin material has come to be used for the production of automobile parts including the covering of electrical wires in an automobile in place of polyvinyl chloride, because polyvinyl chloride discharges a harmful halogen gas on combustion.

A halogen-free resin composition in which a metal hydroxide is blended with a polyolefin-base polymer as a flame-retardant is known as a wear resistant resin composition having the merit of no generation of a poisonous gas such as a halogen gas on combustion (see JP-A-7-176219, JP-A-7-78518 and the like). In order that such a flame-retarding resin composition has a self-extinction property, a large quantity of a metal hydroxide is required to be added; however, this causes problems that mechanical strength such as the wear resistance, tensile strength and the like of the composition are much reduced. In order to prevent the deterioration of mechanical strength, it may be considered that amounts of a polypropylene having a comparatively high hardness and a high density polyethylene are increased, but the flexibility of the covered electrical wire is reduced thereby and the processability becomes poor.

Various specific prior art proposals in this field will now be mentioned.

JP-A-6-290638 discloses resin compositions containing metal hydroxide for electrical wire insulation, in which the resin composition is based on polypropylene (>80%). Additional components are polyethylene modified with acid anhydride and styrene copolymer.

U.S. Pat. No. 5,561,185 describes resin composition for electrical wires containing metal hydroxide, in which the resin components are (a) 40–88.5% by weight of propylene which is 50% by weight or more of a ethylene/propylene random copolymer, (b) 1.5 to 30% by weight of a polyethylene modified with carboxylic acid derivative, e.g. maleic anhydride and (c) 10 to 48% by weight of an ethylene-series copolymer, typically ethylene/vinyl acetate copolymer.

U.S. Pat. No. 5,180,889 also describes a resin composition containing metal hydroxide as a covering of conductors in a crush resistant cable assembly. The resin components are (a) a low density copolymer of ethylene and alpha-olefin, (b) an elastomeric styrene-ethylene-butylene-styrene triblock copolymer, preferably modified with maleic anhydride and (c) optionally an impact propylene and copolymer or polypropylene. Component (a) in the examples is 50% by weight or more of the total resin components.

SUMMARY OF THE INVENTION

The object of the present invention is to provide a halogen-free olefin-based resin composition comprising a mixture of selected components providing a good balance of properties, for example wear resistance, flame resistance, tensile property, flexibility and the like, which are required for the covering material of an electrical wire, e.g. for an automobile.

The present invention provides an olefin-based resin composition containing the following resin components:

(a) 39–94 parts by weight of a propylene polymer having a melt flow rate (MFR) of 0.1–5 g/10 min. and selected from propylene homopolymers and propylene-ethylene copolymers having a propylene content of at least 50% by weight, (b) 1–20 parts by weight of a polypropylene modified with 0.1–10% by weight of an acid anhydride, (c) 5–60 parts by weight of a styrene-based polymeric elastomer modified with 0.1–10% by weight of an acid anhydride, wherein the total of the components (a), (b) and (c) is 100 parts by weight and no other resin component is present in the composition, and further containing (d) 30–200 parts by weight of a metal hydroxide, based on 100 parts by weight of the resin components.

The invention also provides an electrical wire having this composition as a covering on a conductor.

DETAILED DESCRIPTION OF PREFERRED EMBODIMENTS

The respective components of the composition of the present invention are selected to provide in combination the desired properties and are illustrated as follows.

The propylene polymer (a) having an MFR of 0.1–5 g/10 min. is a propylene homopolymer or a propylene-ethylene copolymer of block or random type whose main monomer component (more than 50% by weight) is propylene. Examples of such a propylene polymer having an MFR of 0.1–5 g/10 min. are RB610A, RB410, RB110 and the like, which are commercially available from TOKUYAMA Co., Ltd. When the proportion of the propylene polymer (a) in the total of components (a), (b) and (c) exceeds 94 parts by weight, the flexibility of the composition is damaged and processing becomes difficult. On the other hand, when the proportion of the propylene polymer (a) is less than 39 parts by weight, the wear resistance of the composition is low.

MFR is measured in accordance with JIS K6921-2, the entire disclosure of which is incorporated herein by reference. The unit of MFR is g/10 min. MFR is indicative of molecular length. The selection of a value of 0.1–5 g/10 min. achieves good cold weather performance, in particular avoidance of cracking.

Component (b) is a polypropylene modified with 0.1–10% by weight of a carboxylic acid anhydride, typically unsaturated acid anhydride e.g. maleic anhydride. The polypropylene (b) preferably has a Shore D hardness of 50 or more.

The amount of component (b) in the total of 100 parts by weight of the polymers (a), (b) and (c) is 1–20 parts by weight, and preferably 5–20 parts by weight. When this proportion exceeds 20 parts by weight, flexibility is reduced and processability becomes poor. On the other hand, when the proportion of component (b) is less than one part by weight, the wear resistance is poor.

The polypropylene component (b) gives the composition heat resistance, both during extrusion and if over-heating occurs in use, e.g. in an automobile.

The styrene-based polymeric elastomer, component (c), is a styrene-based elastomer modified with 0.1–10% by weight of a carboxylic acid anhydride, typically unsaturated acid anhydride, for example, maleic acid anhydride. The styrene-based elastomer is preferably a polymer obtained by block-copolymerizing styrene with butadiene, and saturating double bonds of the resulting block-copolymer by hydrogenation (known as SEBS). Typically the ratio of the styrene/butadiene is in the range 3/7 to 2/8 by weight. Alternatively there is used, for example, a styrene-based elastomer obtained by block polymerizing styrene and isoprene and hydrogenating the double bonds of the block copolymer (this product can be regarded as polystyrene-poly(ethylene-propylene)-polystyrene, and is known as SEPS).

The amount of component (c), in the total amount of 100 parts by weight of the polymers (a), (b) and (c) in the composition is 5–60 parts by weight, and preferably 5–50 parts by weight. When this proportion of component (c) exceeds 60 parts by weight, wear resistance is poor. On the other hand, when the proportion of component (c) is less than 5 parts by weight, flexibility is reduced and processability becomes poor.

Magnesium hydroxide, aluminum hydroxide and the like can be exemplified as the metal hydroxide, component (d). It is preferable that the metal hydroxide particles are surface-treated with a coupling agent, particularly a silane coupling agent (for example, an aminosilane coupling agent, a vinylsilane coupling agent, an epoxysilane coupling agent, etc.) and optionally a surface-treating agent such as a higher aliphatic acid (for example, stearic acid, oleic acid, etc.) or the like. The silane coupling agent typically contains Si—O linkages that bond to the hydroxide. Magnesium hydroxide surface-treated with an aminosilane coupling agent is preferable in particular.

The amount of the metal hydroxide based on the total amount (100 parts by weight) of the polymers (a), (b) and (c) in the composition is in the range 30–200 parts by weight, preferably 50–150 parts by weight and more preferably 70–100 parts by weight. When the amount of the metal hydroxide is too large, the elongation of the composition is reduced and the wear resistance, the flexibility and the processability are poor. On the other hand, when the amount of the metal hydroxide is too small, the flame resistance of the composition is reduced.

All of the components (a), (b) and (c) are selected to be halogen-free. Synthetic resin components other than components (a), (b) and (c) are substantially, and preferably completely, absent. Components (a) and (b) are different.

Compounding agents usually included in an olefin-based resin composition, such as, for example, an oxidation inhibitor, a copper inhibitor, a lubricant and the like may be present in the olefin-based resin composition of the present invention provided that their amount does not excessively deteriorate the above-mentioned properties. These and other conventional additives will be readily apparent to those of ordinary skill in the art.

The olefin-based resin composition of the present invention can be prepared by mixing and kneading the respective components according to conventional methods.

Covering an electrical wire core, particularly to make an electrical wire for an automobile, by the resin composition of the present invention may be performed by a conventional method.

The olefin-based resin composition of the present invention when used as the covering material of an electrical wire, e.g. for an automobile, can provide excellent properties such as wear resistance, flame resistance, tensile properties, flexibility and the like, as are required.

In particular, when metal hydroxide particles surface-treated with an aminosilane coupling agent are used, the coupling agent bonds the metal hydroxide with the acid anhydride. The coupling agent has a functional group reacting with the inorganic hydroxide and a functional group reacting with the organic anhydride. Also the epoxysilane and vinylsilane coupling agents have affinity to the hydroxide and the anhydride. Accordingly, the mechanical strength, particularly the wear resistance, can be remarkably improved without damaging the flexibility of the resin composition. Further, when an amino group exists on the lipophilic side of the silane coupling agent molecule, the reaction with the polyolefin and the styrene-based elastomer modified with an acid anhydride advantageously suppresses the hydrophilic property of the amino group.

EXAMPLES

The present invention is more specifically illustrated by the following non-limiting Examples and Comparative Examples.

Examples 1–3 and Comparative Examples 1–6

The components shown in Tables 1 and 2 are mixed at the amounts shown (parts by weight), and kneaded at 250° C. by a twin-screw extruder. Each composition obtained was extrusion-molded at a covering thickness of 0.3 mm around a conductor of 0.5 $mm^2$ cross-section (twisted wire consisting of 7 soft copper wires each of diameter 0.32 mm). A die having a diameter of 1.6 mm and a nipple having a diameter of 1.0 mm were used for extrusion molding. The extrusion temperature was 240–260° C. for die and 230–250° C. for cylinders, and the extrusion molding was carried out at a linear velocity of 100 m/min.

The meanings of the abbreviations in the Tables are as follows:

Propylene BP: a propylene-ethylene block copolymer having a propylene content of more than 50% by weight and MFR of 0.5 (RB610A manufactured by Tokuyama Co., Ltd.).

MAH-PP: a polypropylene modified with 1% by weight of maleic anhydride (ER320P manufactured by Japan Polyolefin Co., Ltd.) having a Shore D hardness of 76.

SEBS: a styrene-based elastomer obtained by saturating double bonds of a block copolymer of styrene and butadiene by hydrogenation (TUFTECH H1041 manufactured by Asahi Chemical Co., Ltd.).

MAH-SEBS: a styrene-based elastomer obtained by saturating the double bonds of a block copolymer of styrene and butadiene by hydrogenation, modified with 1% by weight of maleic anhydride (TUFTECH M1913 manufactured by Asahi Chemical Co., Ltd.).

MAGNIFIN H51V: a magnesium hydroxide surface-treated with an aminosilane coupling agent (manufactured by Alusuisse-Martinswerk gmbh).

As an antioxidant, a hindered phenol-based antioxidant (trade mark "TOMINOX TT" manufactured by Yoshitomi Fine Chemicals Ltd.) was used.

The flame resistance, tensile strength, elongation and wear resistance in Examples 1 and 2 and Comparative Examples 1–6 were measured in accordance with JASO (Japan Automobile Standards Organisation) D 611, the entire disclosure of which is incorporated herein by reference. The wear resistance is an average of 3 samples, and a value 300 cycles or more is deemed acceptable.

The flexibility was evaluated by touch when the electrical wire was folded.

The processability was evaluated by the presence of whisker formation at peeling at the terminal of the electrical wire.

The results are shown in Tables 1 and 2.

TABLE 1

| | Example 1 | Example 2 |
|---|---|---|
| Propylene BP | 60 | 50 |
| MAH-PP | 10 | 10 |
| MAH-SEBS | 30 | 40 |
| SEBS | — | — |
| MAGNIFIN H51V | 90 | 90 |
| Antioxidant | 1 | 1 |
| Total | 191 | 191 |
| Flame resistance | good | good |
| Tensile strength (MPa) | 41.5 | 39.0 |
| Tensile elongation (%) | 503 | 610 |
| Wear resistance (cycle) | 1480 | 638 |
| Flexibility | good | good |
| Processability | good | good |

TABLE 2

| | Comparative Example 1 | Comparative Example 2 | Comparative Example 3 | Comparative Example 4 | Comparative Example 5 |
|---|---|---|---|---|---|
| Propylene BP | 50 | 90 | 40 | 50 | 30 |
| MAH-PP | — | 10 | 30 | — | 10 |
| MAH-SEBS | — | — | — | 50 | 60 |
| SEBS | 50 | — | 30 | — | — |
| MAGNIFIN H51V | 90 | 120 | 90 | 90 | 90 |
| Antioxidant | 1 | 1 | 1 | 1 | 1 |
| Total | 191 | 221 | 191 | 191 | 191 |
| Flame resistance | good | good | good | good | good |
| Tensile strength (MPa) | 34.1 | 22.1 | 33.9 | 38.7 | 30.5 |
| Tensile elongation (%) | 680 | 437 | 107 | 650 | 510 |
| Wear resistance (cycle) | 63 | 4726 | 4341 | 120 | 131 |
| Flexibility | good | bad | bad | good | good |
| Processability | good | bad | bad | good | good |

The results of Example 1 and Comparative Example 5 show that, when the amount of the styrene-based elastomer modified with an acid anhydride deviates from the range of the present invention, the wear resistance and flexibility of the resin composition are incompatible.

The results of Example 2 and Comparative Example 3 show that, when the styrene-based elastomer not modified with an acid anhydride is used, the wear resistance of the resin composition is high, but the flexibility is poor.

Examples 3–4 and Comparative Examples 6–9

The components shown in Tables 3 and 4 are mixed at the amounts shown, and kneaded at 250° C.

The composition obtained was extrusion-molded at a covering thickness of 0.2 mm around a conductor which is the same as in Examples 1 and 2. A die having a diameter of 1.3 mm and a nipple of diameter 0.88 mm were used for extrusion molding. The extrusion temperature was 240–260° C. for the die and 230–250° C. for cylinders, and the extrusion molding was carried out at a linear velocity of 100 m/min.

The flame resistance, tensile strength, elongation and wear resistance of Examples 3 and 4 and Comparative Examples 6–9 were measured in like manner as in Examples 1 and 2. Results are shown in Tables 3 and 4.

TABLE 3

| | Example 3 | Example 4 |
|---|---|---|
| Propylene BP | 80 | 85 |
| MAH-PP | 10 | 10 |
| MAH-SEBS | 10 | 5 |
| SEBS | — | — |
| MAGNIFIN H51V | 70 | 70 |
| Antioxidant | 1 | 1 |
| Total | 171 | 171 |
| Flame resistance | good | good |
| Tensile strength (MPa) | 40.3 | 41.3 |
| Tensile elongation (%) | 162 | 630 |
| Wear resistance (cycle) | 922 | 1351 |
| Flexibility | good | good |
| Processability | good | good |

TABLE 4

| | Comparative Example 6 | Comparative Example 7 | Comparative Example 8 | Comparative Example 9 |
|---|---|---|---|---|
| Propylene BP | 100 | 90 | 70 | 90 |
| MAH-PP | — | — | — | 10 |
| MAH-SEBS | — | — | — | — |
| SEBS | — | 10 | 30 | — |
| MAGNIFIN H51V | 70 | 70 | 70 | 70 |
| Antioxidant | 1 | 1 | 1 | 1 |
| Total | 171 | 171 | 171 | 171 |
| Flame resistance | good | good | good | good |
| Tensile strength (MPa) | 34.2 | 36.8 | 39.5 | 39.5 |
| Tensile elongation (%) | 683 | 710 | 535 | 535 |
| Wear resistance (cycle) | 2131 | 120 | 40 | 2862 |
| Flexibility | bad | good | good | bad |
| Processabilty | bad | good | good | bad |

What is claimed is:

1. An electrical wire comprising an electrically conductive core and a covering on said core, said covering being an olefin-based resin composition comprising a resin consisting essentially of the following resin components:

(a) 39–94 parts by weight of a propylene polymer having a melt flow rate of 0.1–5 g/10 min. and selected from propylene homopolymers or propylene-ethylene copolymers having a propylene content of at least 50% by weight, (b) 1–20 parts by weight of a polypropylene modified with 0.1–10% by weight of an acid anhydride, (c) 5–60 parts by weight of a styrene-based polymeric elastomer modified with 0.1–10% by weight of an acid anhydride wherein a total of the components (a), (b), and (c) is 100 parts by weight, and said olefin-based resin composition further comprising (d) 30–200 parts by weight of a metal hydroxide, based on 100 parts by weight of the resin components.

2. An electrical wire according to claim 1, wherein the amount of component (b) is 5–20 parts by weight, the amount of component (c) is 5–50 parts by weight, and the amount of component (d) is 50–150 parts by weight.

3. An electrical wire according to claim 1, wherein the acid anhydride in components (b) and (c) is maleic acid anhydride.

4. An electrical wire according to claim 1, wherein said metal hydroxide is magnesium hydroxide surface-treated with a silane coupling agent selected from the group consisting of an aminosilane coupling agent, a vinylsilane coupling agent and an expoxysilane coupling agent.

5. An electrical wire according to claim 1, wherein a resin content of said composition consists essentially of said resin components (a)–(c).

6. An electrical wire according to claim 1, wherein a resin content of said composition consists of said resin components (a)–(c).

7. An electrical wire comprising an electrically conductive core and a covering on said core, said covering being an olefin-based resin composition comprising the following resin components:

(a) 39–94 parts by weight of a propylene polymer having a melt flow rate of 0.1–5 g/10 min. and selected from propylene homopolymers or propylene-ethylene copolymers having a propylene content of at least 50% by weight, (b) 1–20 parts by weight of a polypropylene modified with 0.1–10% by weight of an acid anhydride, (c) 5–60 parts by weight of a styrene-based polymeric elastomer modified with 0.1–10% by weight of an acid anhydride, wherein a total of the components (a), (b) and (c) is 100 parts by weight and no other resin component is present in the composition, and said olefin-based resin composition further comprising (d) 30–200 parts by weight of a metal hydroxide, based on 100 parts by weight of the resin components.

8. An electrical wire according to claim 1, wherein said olefin-based resin composition is halogen-free.

9. An electrical wire according to claim 7, wherein said olefin-based resin composition is halogen-free.

10. An electrical wire comprising an electrically conductive core and a covering on said core, said covering being an olefin-based resin composition consisting essentially of the following resin components:

(a) 39–94 parts by weight of a propylene polymer having a melt flow rate of 0.1–5 g/min. and selected from propylene homopolymers or propylene-ethylene copolymers having a propylene content of at least 50% by weight, (b) 1–20 parts by weight of a polypropylene modified with 0.1–10% by weight of an acid anhydride, (c) 5–60 parts by weight of a styrene-based polymeric elastomer modified with 0.1–10% by weight of an acid anhydride, wherein a total of the components (a), (b) and (c) is 100 parts by weight, and said olefin-based resin composition further comprising (d) 30–200 parts by weight of a metal hydroxide, based on 100 parts by weight of the resin components.

11. An electrical wire comprising an electrically conductive core and a covering on said core, said covering being an olefin-based resin composition consisting of the following resin components:

(a) 39–94 parts by weight of a propylene polymer having a melt flow rate of 0.1–5 g/min. and selected from propylene homopolymers or propylene-ethylene copolymers having a propylene content of at least 50% by weight, (b) 1–20 parts by weight of a polypropylene modified with 0.1–10% by weight of an acid anhydride, (c) 5–60 parts by weight of a styrene-based polymeric elastomer modified with 0.1–10% by weight of an acid anhydride, wherein a total of the components (a), (b) and (c) is 100 parts by weight, and said olefin-based resin composition further comprising (d) 30–200 parts by weight of a metal hydroxide, based on 100 parts by weight of the resin components.

* * * * *